US006286599B1

(12) United States Patent
Surjaatmadja et al.

(10) Patent No.: US 6,286,599 B1
(45) Date of Patent: Sep. 11, 2001

(54) METHOD AND APPARATUS FOR LATERAL CASING WINDOW CUTTING USING HYDRAJETTING

(75) Inventors: Jim B. Surjaatmadja; Gary T. Keene; Steven R. Grundmann, all of Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/522,935

(22) Filed: Mar. 10, 2000

(51) Int. Cl.[7] ..... E21B 7/04; E21B 23/04; E21B 29/06

(52) U.S. Cl. ..... 166/298; 166/55.1; 166/240; 175/61

(58) Field of Search ..... 166/55, 55.1, 222, 166/240, 297, 298; 175/61

(56) References Cited

U.S. PATENT DOCUMENTS

| | | | | |
|---|---|---|---|---|
| 3,145,776 | | 8/1964 | Pittman | 166/55 |
| 3,338,305 | | 8/1967 | Pittman et al. | 166/35 |
| 3,892,274 | | 7/1975 | Dill | 166/222 |
| 3,958,641 | | 5/1976 | Dill et al. | 166/312 |
| 4,047,568 | * | 9/1977 | Aulenbacher | 166/298 |
| 4,346,761 | | 8/1982 | Skinner et al. | 166/206 |
| 4,625,799 | * | 12/1986 | McCormick et al. | 166/240 X |
| 4,781,250 | * | 11/1988 | McCormick et al. | 166/240 |
| 4,979,561 | * | 12/1990 | Szarka | 166/240 |
| 4,991,654 | * | 2/1991 | Brandell et al. | 166/240 X |
| 5,010,955 | * | 4/1991 | Springer | 166/298 |
| 5,029,644 | | 7/1991 | Szarka et al. | 166/223 |
| 5,325,917 | | 7/1994 | Szarka | 166/240 |
| 5,335,724 | * | 8/1994 | Venditto et al. | 166/298 |
| 5,361,856 | | 11/1994 | Surjaatmadja et al. | 175/67 |
| 5,494,103 | | 2/1996 | Surjaatmadja et al. | 166/222 |
| 5,499,678 | | 3/1996 | Surjaatmadja et al. | 166/298 |
| 5,499,681 | | 3/1996 | White et al. | 166/382 |
| 5,564,503 | | 10/1996 | Longbottom et al. | 166/313 |
| 5,566,763 | | 10/1996 | Williamson et al. | 166/382 |
| 5,613,559 | | 3/1997 | Williamson et al. | 166/381 |
| 5,617,926 | * | 4/1997 | Eddison et al. | 175/61 |
| 5,735,350 | | 4/1998 | Longbottom et al. | 166/313 |

* cited by examiner

*Primary Examiner*—George Suchfield
(74) *Attorney, Agent, or Firm*—Robert A. Kent; Neal R. Kennedy

(57) ABSTRACT

A method and apparatus using hydrajetting of fluid to cut a lateral casing window for drilling a side track. The apparatus comprises a J-sub having a J-slot therein which guides movement of a jetting nozzle such that a window may be abrasively jetted in well casing in the general shape of the J-slot. In an alternate embodiment, a hydraulically activated actuator sub is used to operate the J-sub. The actuator sub is activated by alternately pressurizing and depressurizing the actuator sub to apply longitudinal movement and torque to the J-sub.

17 Claims, 3 Drawing Sheets

METHOD AND APPARATUS FOR LATERAL CASING WINDOW CUTTING USING HYDRAJETTING

BACKGROUND OF THE INVENTION

1. Field of the Invention

This invention relates to the drilling of side tracks from a main wellbore, and more particularly, to the use of hydrajetting to cut a window in the well casing prior to drilling, thereby facilitating the drilling operation and providing a desired window shape and size. This allows a fit for subsequent tools or casing strings to be inserted through this window.

2. Description of the Prior Art

Many wells today have a deviated bore or side track drilled extending away at an angle from a generally vertical main wellbore. The drilling of such a side track is accomplished by several steps. After casing the main wellbore, a multi-stage milling process is utilized to laterally cut a window through the casing at the general location where it is desired to start the side track. Once the window is milled open, the drilling process may begin. The problem is that casing is made of hard steel, and it is very common for the drill bit to chatter on the steel. This can cause drill breakage and/or produce erratic cutting of the window. Typically, the window is a relatively long, elongated opening, preferably somewhat teardrop shaped, and cutting the window is very time consuming and correspondingly expensive.

There is a need, therefore, for apparatus and methods of cutting windows which can be accomplished more quickly and less expensively and also in a manner assuring a more precise cut of the casing.

The present invention solves this problem by providing for the use of hydrajetting to cut, or at least partially cut, the window in the casing. After the window is more precisely cut using this method, drilling of the actual side track is carried out more quickly and with fewer problems.

SUMMARY OF THE INVENTION

The present invention relates to methods of drilling a side track in a well and apparatus therefor. The method generally comprises the steps of positioning a hydrajetting tool or tools adjacent to a preselected portion of a length of casing in the well, pumping fluid preferably containing abrasives through the tool such that the fluid is jetted therefrom, moving the tool or tools in a predetermined pattern while jetting fluid therefrom such that the pattern is at least partially cut into an inner surface of the well casing to form a window therein, and drilling through the window to form the side track extending from the casing. The preferred predetermined pattern is generally teardrop shaped.

In this method, the tool comprises a guidance or cam means such as a J-sub and a hydrajetting sub with a jetting head and nozzle thereon. The J-sub comprises a collar defining a collar J-slot therein which is generally shaped in the predetermined pattern, and a mandrel having a mandrel pin extending into the collar such that relative movement between the mandrel and collar is guided by the engagement of the mandrel pin in the collar J-slot. The guidance means can comprise substantially any known cam and follower apparatus known by those skilled in the art which would provide the desired shape through travel of the follower, in guiding the jetting head, about the cam. The jetting head is connected to the mandrel and movable therewith. The step of moving the tool comprises moving the mandrel longitudinally and rotationally with respect to the collar.

In an alternate embodiment, the tool comprises an actuator sub connected to at least one mandrel. The step of moving the mandrel comprises activating the actuator sub. Preferably, the actuator sub is hydraulically activated and the step of activating comprises alternately pressurizing and depressurizing the hydrajetting tool.

The actuator sub comprises a housing and a plunger defining a central opening therethrough and movably disposed in the housing. The housing and plunger define a hydraulic chamber therebetween in communication with the central opening of the plunger. Pressurizing the hydraulic chamber relatively moves the housing with respect to the plunger. Relative rotational and longitudinal movement is possible between the plunger and housing.

The method preferably further comprises holding the collar substantially stationary during the step of moving the mandrel. This may comprise hydraulically actuating hydraulic slips on the collar into engagement with the casing.

Stated in another way, the present invention includes a method of forming a side track in a well comprising the steps of (a) positioning a tool string in the casing adjacent to a desired casing portion wherein the tool string comprises a cam and follower such as a J-sub having a J-slot therein and a hydrajetting sub connected to the J-sub and having at least one jetting nozzle thereon directed toward the casing portion, (b) actuating the J-sub such that the hydrajetting sub is substantially moved and guided by the J-slot, (c) substantially simultaneously with step (b), pumping fluid through the tool string and jetting the fluid from the hydrajetting sub such that a window is at least partially cut into the well casing generally in the shape of the J-slot, (d) positioning a drill bit adjacent to the window, and (e) drilling through the window to form the side track extending from the window.

The present invention also includes an apparatus for cutting a window in a portion of well casing. This apparatus generally comprises a J-sub connectable to a tool string, and the hydrajetting sub connected to the J-sub and movable with a portion thereof. The hydrajetting sub comprises a jetting nozzle thereon which may be directed toward the casing.

More specifically, the J-sub comprises a collar defining a collar J-slot therein, the collar J-slot being generally shaped in a predetermined pattern for the window, a mandrel movably disposed in the collar, and a mandrel pin extending from the mandrel into the collar J-slot. As the mandrel pin is moved through the collar J-slot, the mandrel and hydrajetting sub are moved in a path following the predetermined pattern such that fluid jetted from the jetting nozzle will generally cut the window in this pattern.

The apparatus may further comprise an actuator sub connected to the mandrel for providing rotational and longitudinal movement thereof. In the preferred embodiment, this actuator sub is pressure activated and comprises a housing and a plunger defining a central opening therethrough and movably disposed in the housing. Alternately pressurizing and depressurizing the hydraulic chamber results in relative movement between the housing and the plunger. There may be relative longitudinal and rotational movement between the plunger and housing. This results in the mandrel and hydrajetting sub being guided by the engagement of the mandrel pin with the collar J-slot such that the jetted fluid may be directed toward the casing in the pattern of the collar J-slot.

Numerous objects and advantages of the invention will become apparent as the following detailed description of the preferred embodiments of the apparatus and methods is shown in conjunction with the drawings which illustrate such embodiments.

DESCRIPTION OF THE PREFERRED EMBODIMENTS

Figure 1:
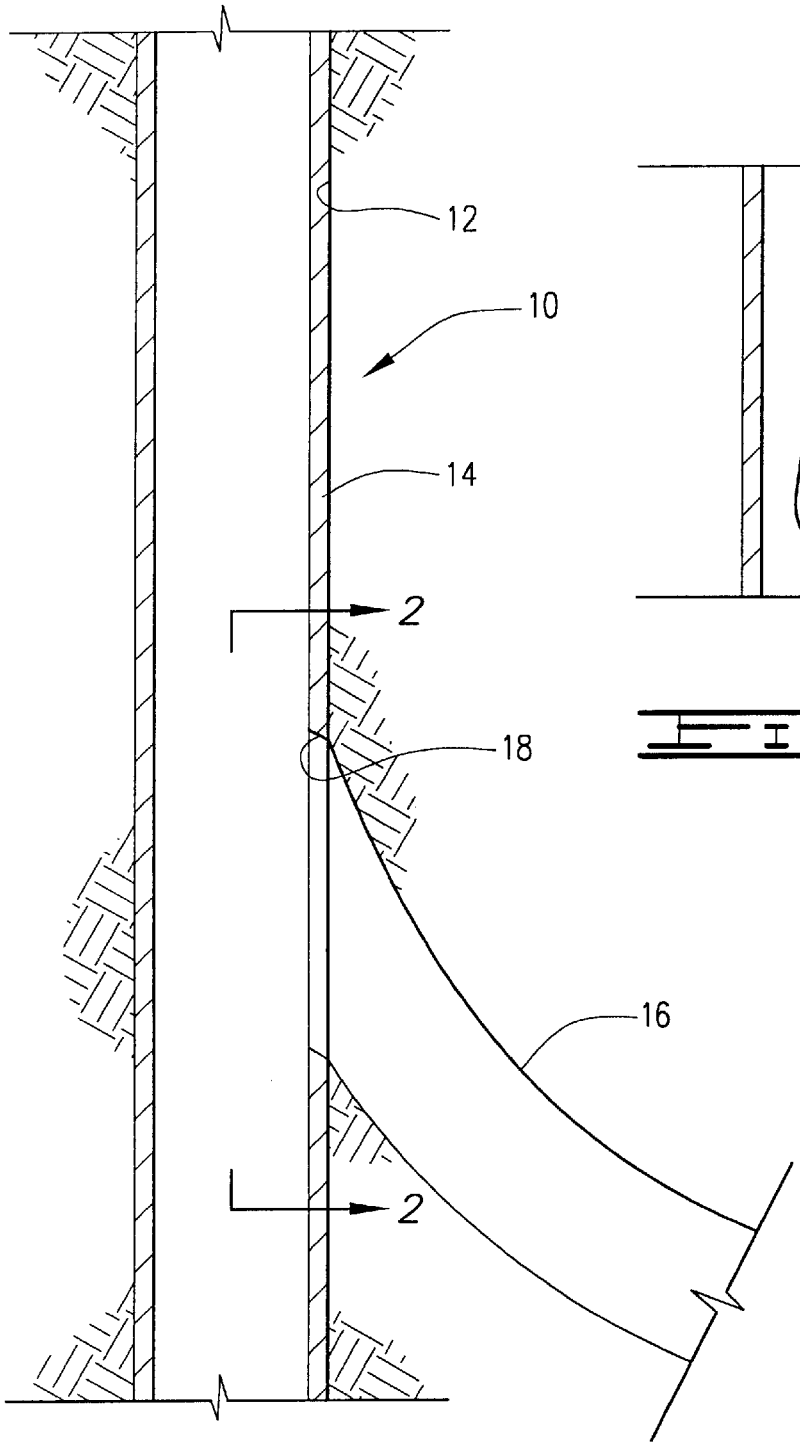
FIG. 1 shows a typical cased well with a side track extending therefrom.

Referring now to the drawings, and more particularly to FIG. 1, a well 10 having a substantially vertical bore 12 is shown. A casing 14 is disposed in bore 12 and cemented therein in a manner known in the art. Extending from bore 12 is a deviated portion or "side track" 16.

Figure 2:
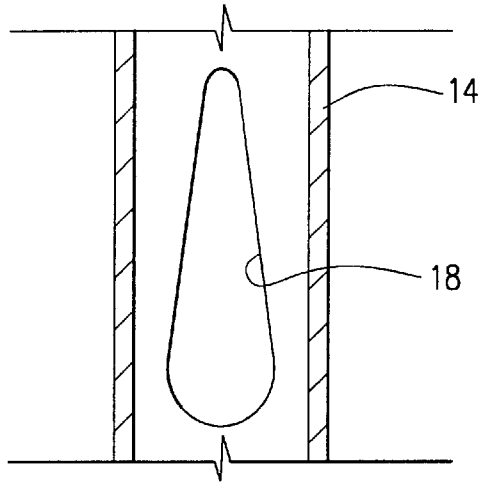
FIG. 2 is a cross section taken along line 2—2 in FIG. 1.

In order to drill side track 16, a window 18 must be cut into casing 12. Referring now also to FIG. 2, window 18 is ideally teardrop shaped. In a typical well casing 14, window 18 is quite elongated and may be twenty feet or longer.

As previously discussed, the cutting of window 18 presents numerous problems with previous methods. Typically, window 18 is cut somewhat erratically and does not have the precise teardrop shape shown in FIG. 2. The result is rough edges and variations in shape that can cause problems in the drilling of side track 16 and also later when various well tools or casing are run into the side track. In addition, when this side track is to be cased and especially cemented, a known window dimension is crucial for the ability to seal or connect these two casing sections.

Figure 3:
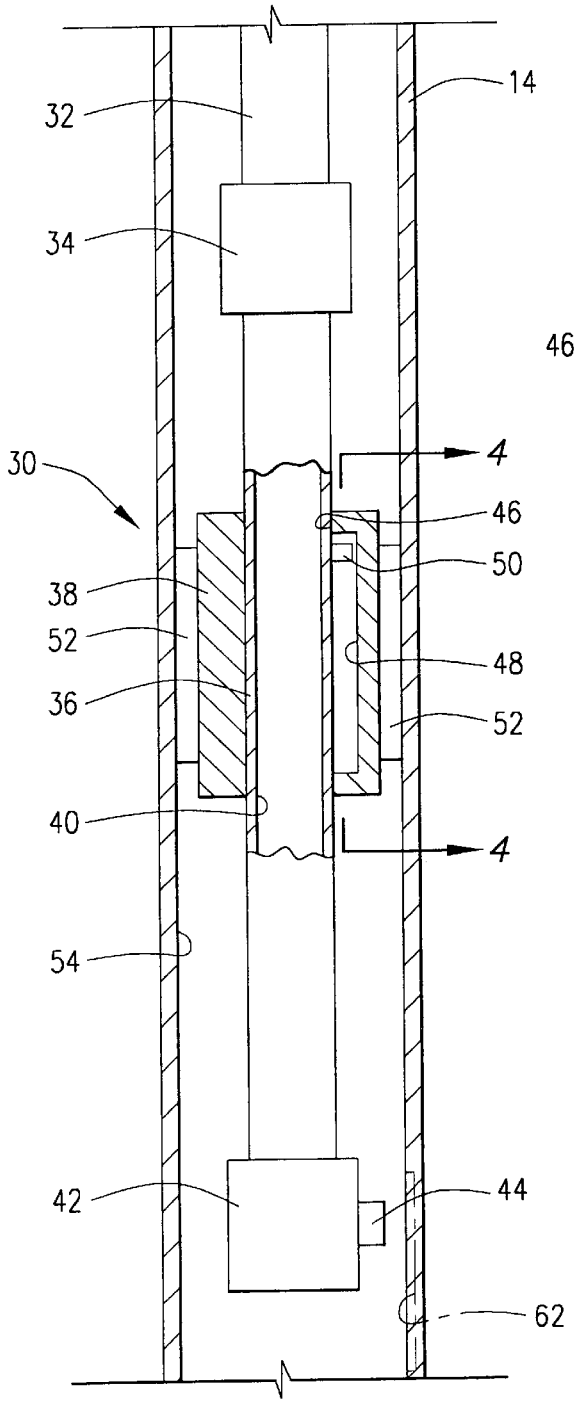
FIG. 3 illustrates a first embodiment of the apparatus of the present invention for lateral casing window cutting using hydrajetting.

Referring now to FIG. 3, a first embodiment of the apparatus of the present invention for lateral casing window cutting using hydrajetting is shown and generally designated by the numeral 30. Apparatus 30 is run into casing 14 on a length of tubing or coiled tubing 32 and connected thereto by a swivel 34.

Apparatus 30 comprises a mandrel 36 movably disposed in a collar 38. Mandrel 36 defines a central opening 40 therethrough which is in communication with coiled tubing 32. An upper portion of mandrel 36 is connected to swivel 34, and a lower portion of mandrel 36 is connected to hydrajetting tool 42. Central opening 40 of mandrel 36 is in communication with a jetting nozzle 44 of hydrajetting tool 42.

An inner surface 46 in collar 38 defines a collar J-slot 48 therein. J-slot 48 is preferably formed by a groove. A mandrel J-slot pin 50 is attached to mandrel 36 and extends into collar J-slot 48.

A plurality of hydraulic slips 52 of a kind known in the art are mounted on collar 38 and may be hydraulically actuated to grippingly engage inner surface 54 of casing 14. In this way, as mandrel 36 is moved longitudinally and rotationally within collar 38, as will be further described herein, movement of collar 38 is prevented.

Figure 4:
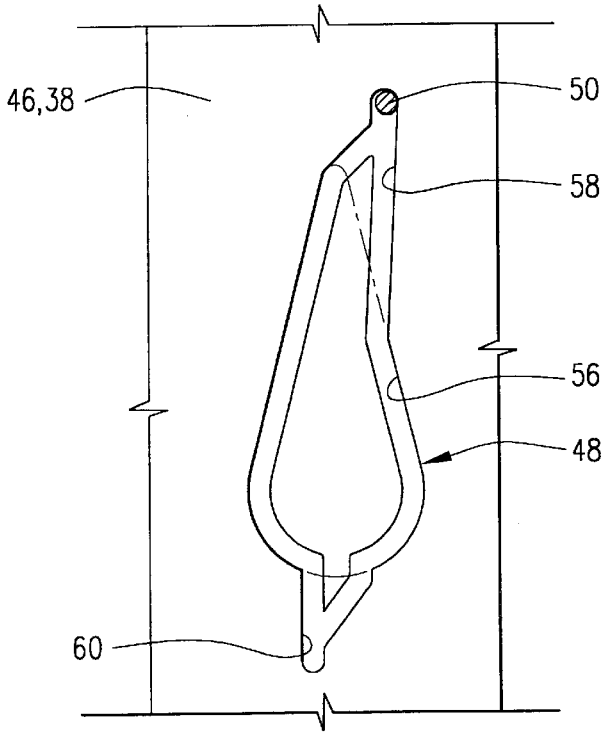
FIG. 4 is a view of a J-slot taken along line 4—4 in FIG. 3.

Referring now also to FIG. 4, the general grooved shape of J-slot 48 is shown. J-slot 48 includes an enlarged central portion 56 with an upper leg 58 extending upwardly therefrom and a lower leg 60 extending downwardly therefrom. The phantom lines shown in FIG. 4 illustrate that a general teardrop shape is generally included within the overall shape of J-slot 48.

In the operation of first embodiment apparatus 30, fluid is pumped down coiled tubing 32, through central opening 40 in mandrel 36. This results in the hydraulic actuation of hydraulic slips 52 and further results in fluid being jetted radially outwardly from jetting nozzle 44 of hydrajetting tool 42 toward casing 14.

As shown in FIGS. 3 and 4, mandrel 36 is shown at a substantially uppermost position in which mandrel pin 50 is positioned at the upper end of upper leg 58 of collar J-slot 48. By moving coiled tubing 32 longitudinally downwardly, it will be seen that mandrel 36 is also moved downwardly so that mandrel pin 50 is moved downwardly through the right side of collar J-slot 48 and guided thereby. When mandrel pin 50 contacts the lower end of lower leg 60 in collar J-slot 48, this signals the operator that mandrel 36 is at its lowermost position. The operation is then reversed so that coiled tubing 32 is raised which results in mandrel pin 50 being moved through the left side of collar J-slot 48 back to the uppermost position which provides another signal to the operator. This downward and upward longitudinal motion may be repeated as many times as necessary.

During the resulting motion of mandrel 36 within collar 38, it will be seen that jetting nozzle 44 is correspondingly moved within casing 14. Movement of mandrel 36 within collar 38 is controlled by the engagement of mandrel pin 50 with collar J-slot 48. Thus, the pattern of fluid jetted from jetting nozzle 44 toward inner surface 54 of casing 14 will substantially follow the shape of collar J-slot 48 so that eventually at least a partial window 62 of this shape is formed in inner surface 54 of casing 14.

The fluid jetted out of jetting nozzle 44 is abrasive and moving at such a velocity that it will cut into inner surface 54. The fluid is generally water with an abrasive material suspended therein. The abrasive may be sand, man-made props, or other softer powders such as colemanite, etc.

After a sufficient number of reciprocating movements of coiled tubing 32 to allow the stream jetted from nozzle 44 to cut window 62, apparatus 30 may be removed from casing 14 so that a drilling operation may be carried out. If the window is completely cut, some provision is placed on the bottom of the jet sub to carry this window section out of the hole. Because window 62 is at least partially cut into casing 14, and may be cut completely through the casing, the drilling operation necessary to carry out the drilling of a side track, such as side track 16 shown in FIG. 1, is greatly facilitated and simplified.

Figure 5:
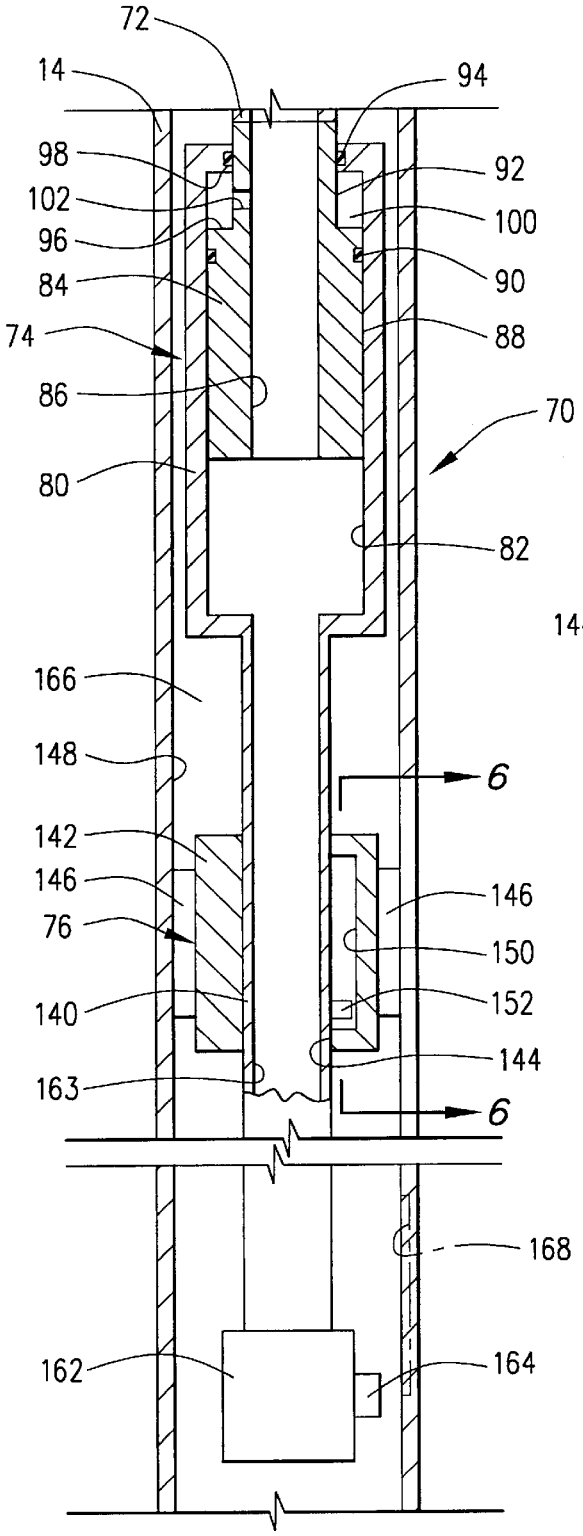
FIG. 5 shows an alternate embodiment of the window cutting apparatus of the present invention.

Referring now to FIG. 5, a second embodiment of the apparatus of the present invention is shown and generally designated by the numeral 70. As will be seen, second embodiment apparatus 70 provides a means for more precisely cutting a window in the casing.

Apparatus 70 is run into casing 14 on a length of coiled tubing 72. Apparatus 70 includes a pressure activated actuator sub 74 and a J-sub 76 comprising a cam and follower arrangement positioned therebelow.

Actuator sub 74 comprises a housing 80 defining an inner surface 82 therein. A plunger 84 is attached at its upper end to coiled tubing 72 and extends into housing 80. A central opening 86 in plunger 84 is in communication with coiled tubing 72.

Plunger 84 has a first outside diameter 88 which fits within inner surface 82 of housing 80. A sealing means, such as a seal 90 provides sealing engagement therebetween.

Plunger 84 has a smaller second outside diameter 92 which is spaced inwardly from inner surface 82 of housing 80. Another sealing means, such as a seal 94, provides sealing engagement between housing 80 and second outside diameter 92 of plunger 84.

Plunger 84 has an upwardly facing shoulder 96 thereon which extends between first outside diameter 88 and second outside diameter 92. A downwardly facing shoulder 98 in housing 80 generally faces shoulder 96 on plunger 84. It will thus be seen that a generally annular hydraulic chamber 100 is defined between shoulders 96 and 98 and between inner surface 82 of housing 80 and second outside diameter 92 of plunger 84. A port 102 defined transversely through plunger 84 provides communication between central opening 86 and hydraulic chamber 100.

J-sub 76 comprises a mandrel 140 which is connected to housing 80 of actuator sub 74. Mandrel 140 is movably disposed in a collar 142 of J-sub 76. Thus, mandrel 140 extends through an inner surface 144 of collar 142. A plurality of hydraulic slips 146 are attached to collar 142 and, when actuated, grippingly engage an inner surface 148 in casing 14. Thus, movement of collar 142 with respect to casing 14 is substantially prevented when mandrel 140 is moved within the collar as will be further described herein.

Figure 6:
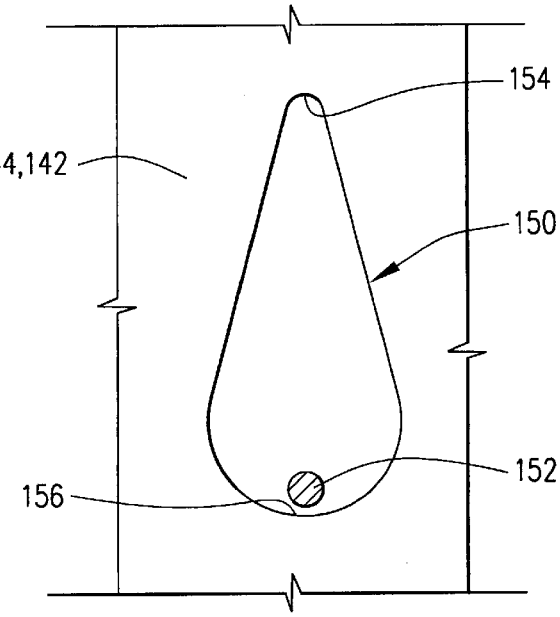
FIG. 6 illustrates a J-slot taken along line 6—6 in FIG. 5.

A collar J-slot 150 is defined in inner surface 144 of collar 142. A mandrel J-slot pin 152 is attached to mandrel 140 and extends into collar J-slot 150. Referring now to FIG. 6, the shape of collar J-slot 150 is shown. In this embodiment, collar J-slot 150 is in the shape of an elongated teardrop having a smaller upper end 154 and an enlarged lower end 156.

The lower end of mandrel 140 is connected to a hydrajetting tool 162 with a jetting nozzle 164. Hydrajetting tool 162 is substantially the same as hydrajetting tool 142 shown in first embodiment 30.

A central opening 163 is defined in mandrel 140. It will be seen that hydrajetting tool 162 and jetting nozzle 164 are in communication with coiled tubing 72 through central opening 86 in plunger 84 of actuator sub 74, inner surface 82 in housing 80 of the actuator sub, and central opening 163 in mandrel 140 of J-sub 76. That is, fluid pumped down coiled tubing 72 will be jetted out of nozzle 164 in a manner herein described.

In operation, apparatus 70 is run into well casing 114 on coiled tubing 72 to the desired position. Fluid is pumped down coiled tubing 72. This causes hydraulic slips 146 to be actuated and fluid to be jetted out of nozzle 164 radially toward inner surface 148 of casing 14. It also causes fluid to be forced into hydraulic chamber 100. It will be seen that the pumping of fluid into hydraulic chamber 100 results in housing 80 being raised with respect to plunger 84 because of the increased volume of chamber 100.

By applying left or right torque on coiled tubing 72, this torque will also be applied to plunger 84. While substantially simultaneously pressurizing and depressurizing hydraulic chamber 100 with respect to the fluid in a well annulus 166 between apparatus 70 and casing 14, housing 80 may thus be moved upwardly, downwardly and rotationally as many times as desired with respect to plunger 84.

This movement of housing 80 of J-sub 74 will therefore result in reciprocating movement of mandrel 140 in J-sub 76 and the application of torque to the mandrel. Thus, mandrel pin 152 is moved around collar J-slot 150 so that it traces the teardrop shape thereof. This teardrop shaped movement of mandrel pin 152 and mandrel 140 is directly translated to corresponding movement of hydrajetting tool 162 and jetting nozzle 164 thereof so that a fairly precisely teardrop shaped window 168 is cut at least partially into casing 14.

Some of the torque applied to mandrel 140 results in mandrel pin 152 being moved through collar J-slot 150 while collar 142 is locked in place by hydraulic slips 146, as previously described. The additional torque applied to mandrel 140 is absorbed by the flexibility of coiled tubing 72. That is, mandrel 140 will be moved as desired and any additional torque from actuator sub 74 will result in slight twisting of coiled tubing 72. This twisting over the length of coiled tubing 72 is essentially negligible. J-slot 150 while collar 80 is locked in place by hydraulic slips 146, as previously described. The additional torque applied to mandrel 140 is absorbed by the flexibility of coiled tubing 72. That is, mandrel 140 will be moved as desired and any additional torque from actuator sub 74 will result in slight twisting of coiled tubing 72. This twisting over the length of coiled tubing 72 is essentially negligible.

Further, as those skilled in the art will understand, multiple jetting heads may be utilized which may follow around the cam shape to cut the window. Alternatively two or more jetting heads may be utilized that would move upwards or downwards on opposite sides of the cam in relation to relative movement of plunger 84 with respect to housing 80 to simultaneous cut both sides of the teardrop shaped window without having to circumferentially trace the entire path of the cam with jetting head.

Thus, second embodiment apparatus 70 provides an even more precisely shaped window 168 in casing 14 than the window 62 provided by first embodiment apparatus 30. Drilling is thus more easily carried out than with prior art methods, and the problems associated with erratic cutting are substantially eliminated.

It will be seen, therefore, that the apparatus and method for lateral casing window cutting using hydrajetting of the present invention are well adapted to carry out the ends and advantages mentioned as well as those inherent therein. While presently preferred embodiments of the apparatus and steps in the method have been shown for the purposes of this disclosure, numerous changes in the arrangement and construction of parts in the apparatus and steps in the method may be made by those skilled in the art. All such changes are encompassed within the scope and spirit of the appended claims.

What is claimed is:

1. A method of drilling a side track in a well comprising the steps of:

positioning a hydrajetting tool adjacent to a preselected portion of a length of casing in the well;

pumping fluid through the tool such that said fluid is jetted therefrom;

moving the tool in a predetermined pattern while jetting fluid therefrom such that said pattern is at least partially cut into an inner surface of the well casing to form a window therein; and drilling through said window to form the side track extending from the casing.

2. The method of claim 1 wherein said predetermined pattern is generally teardrop shaped.

3. The method of claim 1 wherein:

said tool comprises:

a J-sub comprising a collar defining a collar J-slot therein, said J-slot being generally shaped in said predetermined pattern; and a mandrel having a mandrel pin extending into said collar J-slot such that relative movement between said mandrel and collar is guided by the engagement of said mandrel pin with said collar J-slot; and a jetting head connected to said mandrel and movable therewith; and said step of moving the tool comprises moving said mandrel longitudinally and rotationally with respect to said collar.

4. The method of claim 3 wherein:

said tool comprises an actuator sub connected to said mandrel; and said step of moving said mandrel comprises activating said actuator sub.

5. The method of claim 4 wherein activating said actuator sub comprises alternately pressurizing and depressurizing said hydrajetting tool.

6. The method of claim 4 wherein said actuator sub comprises:

a housing; and a plunger defining a central opening therethrough and movably disposed in said housing, said housing and said plunger defining a hydraulic chamber therebetween in communication with said central opening of said plunger;

wherein, pressurizing said hydraulic chamber relatively moves said housing with respect to said plunger.

7. The method of claim 6 wherein said housing may move rotationally and longitudinally with respect to said plunger.

8. The method of claim 4 further comprising holding said collar substantially stationary during said step of moving said mandrel.

9. The method of claim 8 wherein said step of holding comprises hydraulically actuating slips on said collar into engagement with the casing.

10. A method of forming a side track in a well, said method comprising the steps of:

(a) positioning a tool string in the casing adjacent to a desired casing portion, said tool string comprising:

a J-sub having a J-slot or cam surface therein; and a hydrajetting sub connected to said J-sub or cam surface and having at least one jetting nozzle thereon directed toward the casing portion;

(b) actuating said J-sub or cam surface such that said hydrajetting sub is substantially moved and guided by said J-slot or cam surface;

(c) substantially simultaneously with step (b), pumping fluid through the tool string and jetting said fluid from said hydrajetting sub such that a window is at least partially cut into the well casing generally in the shape of said J-slot or cam surface;

(d) positioning a drill bit adjacent to said window; and (e) drilling through said window to form the side track extending from said window.

11. The method of claim 10 wherein said J-slot or cam surface is substantially in the shape of a teardrop.

12. The method of claim 10 wherein:

said tool string further comprises an actuator connected to said J-sub or cam surface; and step (b) comprises hydraulically actuating said actuator.

13. The method of claim 12 wherein step (b) comprises alternately pressurizing and depressurizing said actuator.

14. The method of claim 12 wherein said actuator comprises:

a housing; and a plunger defining a central opening therethrough and movably disposed in said housing, said housing and said plunger defining a hydraulic chamber therebetween in communication with said central opening of said plunger;

wherein, pressurizing said hydraulic chamber relatively moves said housing and plunger.

15. The method of claim 14 wherein there may be relative rotational and longitudinal movement between said housing and plunger.

16. The method of claim 10 further comprising holding said collar substantially stationary during step (b).

17. The method of claim 16 wherein:

said collar has hydraulic slips thereon; and said step of holding said collar comprises actuating said slips into engagement with the casing.

* * * * *